US006467757B1

(12) United States Patent
Douyama

(10) Patent No.: US 6,467,757 B1
(45) Date of Patent: Oct. 22, 2002

(54) CARBURETOR VALVE ADJUSTMENT LIMITER CAP ASSEMBLY

(75) Inventor: Yoshiaki Douyama, Miyagi (JP)

(73) Assignee: Walbro Japan, Inc., Tokyo (JP)

( * ) Notice: Subject to any disclaimer, the term of this patent is extended or adjusted under 35 U.S.C. 154(b) by 2 days.

(21) Appl. No.: 09/669,579

(22) Filed: Sep. 26, 2000

(30) Foreign Application Priority Data

Sep. 27, 1999 (JP) ..... 11-271932
Oct. 20, 1999 (JP) ..... 11-298442
Oct. 29, 1999 (JP) ..... 11-309829

(51) Int. Cl.[7] ..... F02M 3/08
(52) U.S. Cl. ..... 261/71; 137/382; 261/DIG. 84
(58) Field of Search ..... 261/71, DIG. 84, 261/DIG. 38, DIG. 23, DIG. 24; 137/382

(56) References Cited

U.S. PATENT DOCUMENTS 3,618,906 A * 11/1971 Charron ..... 261/71 X
5,252,261 A * 10/1993 Gerhardy ..... 261/DIG. 84
5,322,645 A * 6/1994 Hammett et al. .... 261/DIG. 84
5,525,267 A * 6/1996 Araki ..... 261/71
5,630,965 A * 5/1997 Shaw et al. ..... 261/71
5,635,113 A * 6/1997 Walsh et al. ..... 261/71
5,667,734 A * 9/1997 Ohgane ..... 261/DIG. 84
5,707,561 A * 1/1998 Swanson ..... 261/DIG. 84
5,753,148 A * 5/1998 King et al. ..... 261/71
5,776,379 A 7/1998 Bowles ..... 261/71
5,955,007 A * 9/1999 Koizumi et al. ..... 261/DIG. 38
5,984,281 A * 11/1999 Hacker et al. ..... 261/DIG. 38
6,302,384 B1 * 10/2001 Douyama ..... 261/DIG. 84

FOREIGN PATENT DOCUMENTS

| | | | | |
|---|---|---|---|---|
| DE | 19814683 | | 6/1999 | |
| EP | 0589405 | | 3/1994 | |
| JP | 53-14234 | * | 2/1978 | ..... 261/DIG. 84 |
| SU | 641145 | * | 1/1979 | ..... 261/DIG. 84 |
| WO | 9617163 | | 6/1996 | |

* cited by examiner

*Primary Examiner*—Richard L. Chiesa
(74) *Attorney, Agent, or Firm*—Reising, Ethington, Barnes, Kisselle, Learman & McCulloch PC

(57) ABSTRACT

A limiter cap assembly of a carburetor for a two cycle engine restricts maximum and minimum fuel amounts. The limiter cap assembly has a first cap engaged telescopically to the end of a low speed needle valve and a second cap engaged telescopically to the end of a high speed needle valve. The first and second caps are identical, each having a first tab and a second tab. The first tab sets the maximum fuel amount by contacting the adjacent cap and the second tab sets the minimum fuel amount by also engaging the adjacent cap. The first and second tabs are axially spaced apart so as not to obstruct rotation of the adjacent cap via the adjacent tabs. A housing having a lid encompasses the first and second caps. The caps each have a plurality of projections which engage an inner edge of the lid, thereby, provisionally staging the caps to the carburetor while final needle valve adjustments are made.

16 Claims, 2 Drawing Sheets

CARBURETOR VALVE ADJUSTMENT LIMITER CAP ASSEMBLY

REFERENCE TO RELATED APPLICATION

Applicant claims priority of Japanese patent applications, Ser. Nos. 11-271,932, filed Sep. 27, 1999; 11-298,442, filed Oct. 20, 1999; and 11-309,829, filed Oct. 29, 1999.

1. Field of the Invention

This invention relates to a valve adjustment limiter cap assembly, and more particularly to a carburetor valve adjustment limiter cap assembly for an internal combustion engine.

2. Background of the Invention

Government agencies of an increasing number of countries are applying exhaust emission control regulations to protect the environment. These regulations are being applied to all combustion engines including portable or two cycle engines used in common equipment such as chain saws, lawn mowers and hedge trimmers. One means of limiting excessive exhaust emissions in a small two cycle engine is to restrict the maximum amount of fuel delivered to the combustion chamber. This maximum fuel amount is pre-set on each individual engine by the engine manufacturer with the understanding that the end user requires some adjustment capability to meet changing work conditions and environmental factors such as altitude. The higher the altitude, the lower the air density, and the leaner the fuel to air ratio necessary to operate the engine. The user of the engine must therefore be able to adjust the fuel to air mixture ratios and may do so via low and high speed needle valves protruding from the carburetor.

Not only is it desirable to limit the richness of the fuel to air mixture because of exhaust emission regulatory concerns, but the engine manufacturer of a two cycle engine product also wants to restrict minimum amounts of fuel, or the leanness of the fuel to air mixture. Often a user will desire more power from a two cycle engine and will attempt to operate the engine in an ultra-lean state. This will deprive a two cycle engine of proper cooling and will lead to engine damage and warranty problems. Therefore, the caps are designed not only to restrict the carburetor to a maximum amount of fuel, but also to restrict the carburetor to a minimum amount of fuel.

Limiter caps secured to the projecting ends of the low and high speed needle valves are commonly used to restrict the user from demanding too much fuel from a carburetor which could exceed regulatory emission limits. The user purchases the engine already factory set to a maximum fuel amount, adequate for operation in low lying areas. Should the engine be utilized in a high altitude area, the user can still decrease the amount of fuel supplied to compensate for the lower air density.

In a conventional needle valve fuel limiter cap of the carburetor, the cap has a single tab radially projecting outward to engage a stop or an adjacent cap. The single tab limits rotation of the needle valve in both the fuel rich and fuel lean directions and thereby limits fuel adjustment capability. When both the low and high speed needle valves have limiter caps, the caps typically abut due to physical limitations and the stop for the tab is the adjacent cap. The tabs must therefore be axially offset so as not to obstruct the rotation of the adjacent needle valve. To prevent obstruction, caps are made of different shapes between the low and high speed needle valves.

Because a particular carburetor may be applied to numerous engine applications, setting a specific carburetor to a maximum fuel amount prior to flowing on a specific engine, or within a specific environment such as altitude, is not practical. The limiter cap assembly is therefore supplied in a non-engaged mode and often separate from the carburetor itself. Supplying a carburetor in separate parts contributes to manufacturing or assembly inefficiencies and possible regulatory violations if the caps are never actually engaged to the valves.

SUMMARY OF THE INVENTION

A limiter cap assembly is engaged to a low and preferably a high speed valve of a carburetor. The valves are engaged threadably to a carburetor body. Rotation of the valve in one direction increases the fuel to an operating engine and rotation of the valve in the opposite direction decreases the fuel amount. A cylindrical first cap attaches telescopically to a head concentrically formed to a rotating and axial moving shank of the low speed valve. Restricting rotation of the shank and therefore axial movement, are first and second tabs projecting radially outward from a peripheral face of the first cap.

A second cap attaches to the head of the high speed valve and longitudinally abuts and axially aligns to the first cap. The second cap, preferably identical to the first cap, is rotated about 180 degrees relative to the first cap prior to mounting on the valve. The first tab of the first cap is in contact with the peripheral face of the second cap when the low speed valve is in the maximum fuel position. The second tab of the first cap is in contact with the peripheral face of the second cap when the low speed valve is in the minimum fuel position. Preferably, the low speed valve rotates in the same direction as the high speed valve and the first and second tabs of the second cap function the same as the tabs of the first cap.

Preferably, the cap assembly has a lid disposed over the first and second caps. The lid has an inner edge defining an opening whose profile matches the mounting profile of the first and second caps. The caps each have axially aligned trailing projections and axially aligned mid projections. The inner edge of the lid is snap fitted between the trailing and mid projections when the caps are in a provisional mounted position.

Objects, features and advantages of this invention include the use of two identical limiting caps, engaged to respective low and high speed valves. The identical limiting caps also provide a simple and inexpensive means to provisional mount the caps to the lid of a protective housing prior to final flow adjustments of the carburetor.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
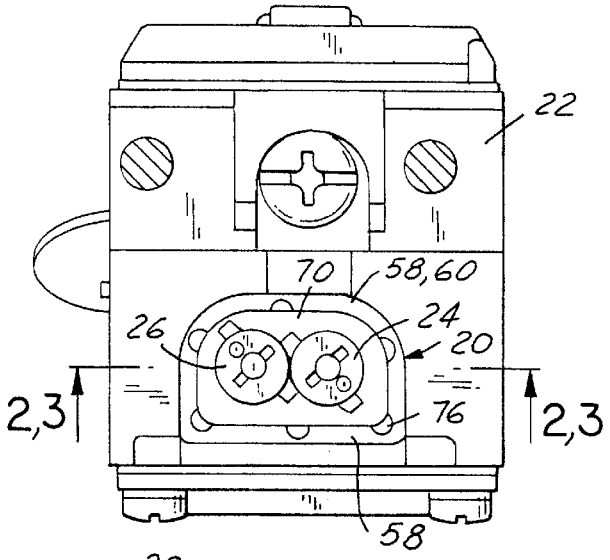
FIG. 1 is a side view of a carburetor having a limiter cap assembly of this invention.
Figure 2:
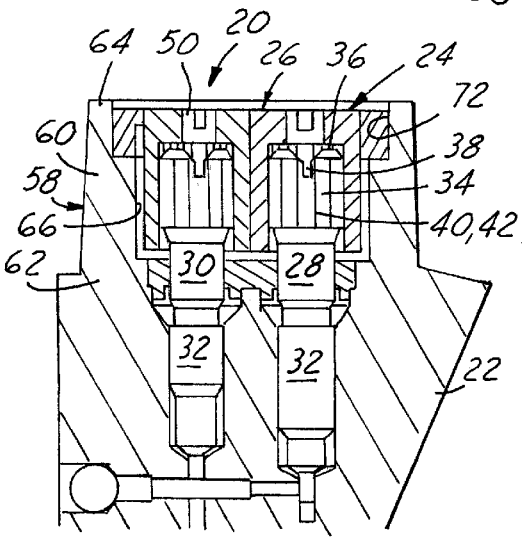
FIG. 2 is a cross sectional view of the limiter cap assembly for both a low and high speed valves taken along line 2—2 of FIG. 1.
Figure 3:
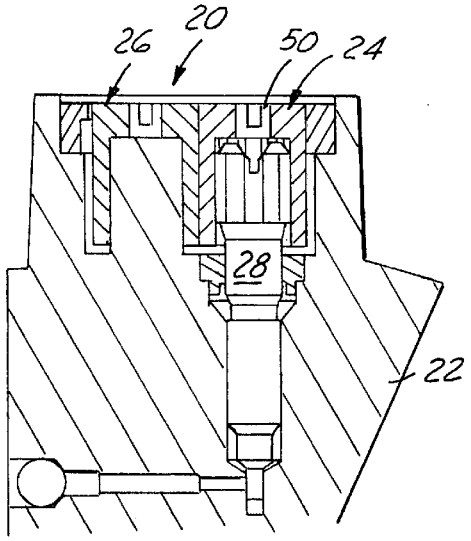
FIG. 3 is a cross sectional view of the limiter cap assembly for only the low speed valve taken along line 3—3 of FIG. 1.

Referring in more detail to the drawings, FIGS. 1–3 show a fuel limiting cap assembly 20 mounted on a carburetor body 22 in a user assembled state, embodying the present invention. The cap assembly 20 has a first cap 24 abutting longitudinally a second cap 26. The first cap 24 engages and restricts the fuel flow adjustment capability of a low speed valve 28, preferably of a needle type. The second cap 26 engages and restricts the fuel flow adjustment capability of a high speed valve 30, if one exists on a particular carburetor application. In either case, the functional first cap 24, and possibly the second cap 26 depend upon the presence of each other to accomplish fuel flow adjustment restriction. FIG. 2 shows the fuel limiting cap assembly 20 with the high speed valve 30 and FIG. 3 shows a carburetor application without the high speed valve, wherein the second cap 26, identical to the first cap 24, is mounted over a portion of the carburetor body 22 resembling a post-like structure. In the FIG. 3 embodiment, the second cap 26 can be unitary and integral to the carburetor body 22.

Figure 4:
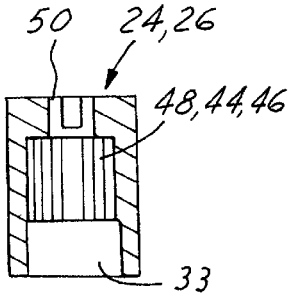
FIG. 4 is a longitudinal cross sectional view of a first cap or a second cap.

Referring to FIG. 2 and FIG. 4, the low and high speed valves 28, 30 are generally parallel, disposed side-by-side, and each has a shank 32 threadably engaging the carburetor body 22. Rotation of the shank 32 adjusts and controls fuel flow within the carburetor by axial movement of its tip in and out of a fuel feed channel and relative to the carburetor body 22 as is well known in the art. Concentrically projecting outward from a leading end of the shank 32 and the carburetor body 22 is a valve head 34. In order to adjust the valves 28, 30, a diametric recess 38 is defined by a leading surface 36 of the head 34. The recess 38 is generally perpendicular to the longitude of the shank 32 and receives a tool, such as a screwdriver, for rotation of the valve shank 32. An outer radial surface 40 of head 34 is generally perpendicular to the leading surface 36 and has axially extending serrations 42 which mate with serrations 44 of caps 24, 26. The serrations 44 are disposed on an inner radial surface 46 defining a leading bore 48 of the caps 24, 26. Leading bore 48 is concentric to and disposed axially outward from trailing bore 33. Unlike the leading bore 48, the trailing bore 33 is too large radially to engage head 34. This non-engagement permits staging or initial assembly of caps 24, 26 to the cap assembly 20 prior to final flow adjustment of the low and high speed valves 28, 30.

Figure 10:
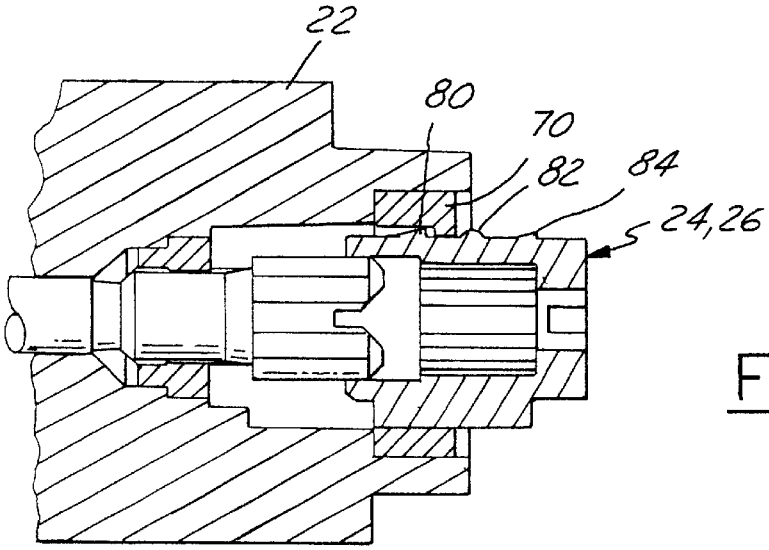
FIG. 10 is a cross sectional view of the cap assembly assembled in a provisional or staged state.

With the initial staging of caps 24, 26 to each head 38 in a provisional mounted position, see FIG. 10, a tool such as a screw driver is inserted through a hole 50 of caps 24, 26 and into the recess 38 or slot of head 34 permitting final adjustments to valves 28, 30. The leading bore 48 is disposed communicatively between the tool through hole 50 and the trailing bore 33. The tool through hole 50 is generally concentric to the trailing and leading bores 33, 48.

Figure 5:
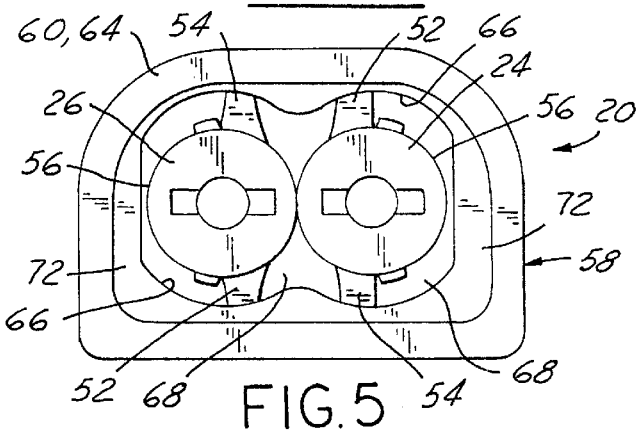
FIG. 5 is a perspective view of the cap assembly with a lid removed to sho w internal detail.
Figure 6:
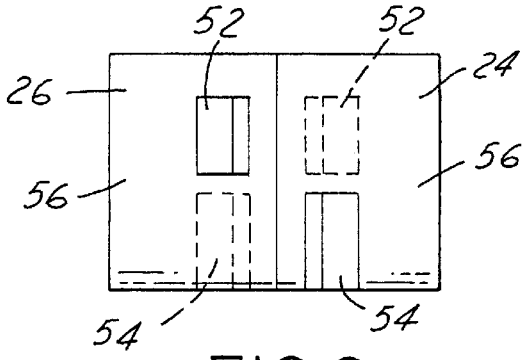
FIG. 6 is a perspective view of the first and second caps.
Figure 7:
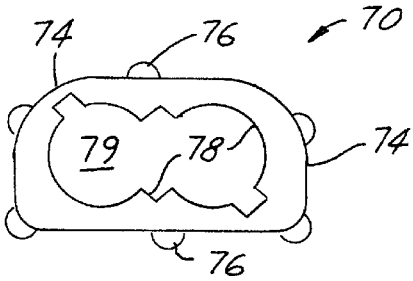
FIG. 7 is a top view of a lid.

As shown in FIG. 5 and FIG. 6, the first cap 24 and the second cap 26 are identical and can be commonly used for both valves. To be commonly used, the first and second caps 24, 26 are offset rotationally by about 180 degrees when mounting. Restricting the fuel flow adjustment of valves 28, 30 for each respective cap 24, 26 are a first tab 52 and a second tab 54. The first and second tabs 52, 54 project radially outward from a peripheral face 56 of each cap 24, 26. The first tab 52 is offset circumferentially, or out of phase, from the second tab 54 by an amount dependent upon the operating characteristics of the carburetor, but in no event will valves 28, 30 be capable of a full 360 degrees of rotation by the user of the engine. Preferably, the circumferential offset is approximately 180 degrees. Therefore, (as illustrated in FIG. 5) with counterclockwise rotation opening the valves 28, 30, the first tab 52 of the first cap 24 limits the maximum fuel amount and is directed upward, and the first tab 52 of the second cap 26 limits the maximum fuel amount and is directed downward; similarly, the second tab 54 of the first and second caps 24, 26 limit the minimum fuel amount. So that the first tab 52 of the first cap 24 does not obstruct the second tab 54 of the second cap 26, and vice-versa, during user rotational adjustments of valves 28, 30, the first tab 52 is offset axially from the second tab 54.

The first tab 52 prevents an engine from running too rich or with too much fuel, by limiting counter-clockwise rotation of either low speed valve 28 or high speed valve 30 via respective first cap 24 and second cap 26. The first tab 52 of first cap 24 will contact a peripheral face 56 of the second cap 26 thereby preventing further counter-clockwise rotation of first cap 24 and a further increase in fuel. Vice-versa, the first tab 52 of the second cap 26 will contact the peripheral face 56 of the first cap 24 thereby preventing further counter-clockwise rotation of the second cap 26 and a further increase in fuel. The second tab 54 performs in the same way as the first tab 52 but limits an engine from running too lean, or sets a minimum fuel amount, and adjusts to a maximum lean position or minimum fuel amount with clockwise rotation.

The rotation of the caps 24, 26 and thereby the valves 28, 30 may be reversed and is dependent upon the left or right hand threading orientation of the valves 28, 30 to the carburetor body 22. Furthermore, the rotation of the low speed valve 28 can be counter directional to high speed valve 30, not in the same direction as discussed above, if the valves have threads of the opposite hand. If the rotational direction of the high speed valve 30 is reversed by using left hand threads, the second tab 52 of the second cap 26 will contact the peripheral face 56 of the first cap 24 thereby preventing further clockwise rotation of the second cap 26 and a further increase in fuel. As shown in FIG. 6, the axial position of the first tab 52 leads or is forward of the axial position of the second tab 54 for both caps 24, 26. This axial positioning order of first and second tabs 52, 54 may be reversed for both first and second caps 24, 26 without impacting the functioning of the cap assembly 22.

The first and second caps 24, 26 are each unitary in composition and are molded of a synthetic resin material. This generally homogeneous material may be Zytel 7 or Minlon 7 which are nylon formulations and registered trademarks of E.I. DuPont De Nemours and Company. Other high temperature resistant thermoplastic material may be used. However, the cap must be made of a strong resilient material capable of frictionally engaging the head 34 and able to resist brittle fracture if tampered with.

Referring to FIGS. 1,2, and 5, the first and second caps 24,26 are protected by a housing 58. Encircling the first and second caps 24, 26 is a wall 60 attached rigidly to the carburetor body 22 at a secured end 62. The wall 60 projects outward from the carburetor body 22 to a free end 64. An inner side 66 of the wall 60 extends from the secured end 62 to the free end 64 and defines a cavity 68. The first and second caps 24, 26 reside within the cavity 68. The profile of the cavity 68 outlined by the inner side 66 is substantially similar to the profile created when the first and second caps 24, 26 fully rotate from the maximum fuel amount position to the minimum fuel amount position. The close proximity of the inner side 66 to the rich and lean restricting tabs 52, 54 provides additional support transversely for the low and high speed valves 28, 30 during user adjustments.

Referring to FIGS. 1, 2, 5 and 7, the cavity 68 housing the first and second caps 24, 26 is further defmed by a lid 70 which engages to the free end 64 of the wall 60. The inner side 66 of the wall 60 defines a recess 72 generally located at the free end 64. A peripheral edge 74 of the lid 70 engages to the inner side 66 within the recess 72. A plurality of fmgers 76 project outward from the peripheral edge 74 to engage the free end 64 of the wall 60. An adhesive (not shown) is disposed between the free end 64 and the fingers 76 to rigidly secure the lid 70 to the wall 60. The fingers 76 can be press fitted into the free end 64 thereby providing a flush surface, or may be glued to the top of the free end 64.

An inner edge 78 of the lid 70 defines an opening 79 having a profile that conforms to the initial mounting profile of the first and second caps 24, 26. Typically, with the lid 70 engaged to the wall 60 low and high speed valves 28, 30 are factory adjusted by the carburetor manufacturer. Then the first and second caps 24, 26 are mounted provisionally by the carburetor manufacturer, or in a pre-user state, usually with the rich restricting tabs 54 at the maximum fuel amount setting. Therefore, the first tabs 52 are in contact with the adjacent peripheral surface 56 and the opening 79 of the lid 70 is shaped accordingly.

Figure 8:
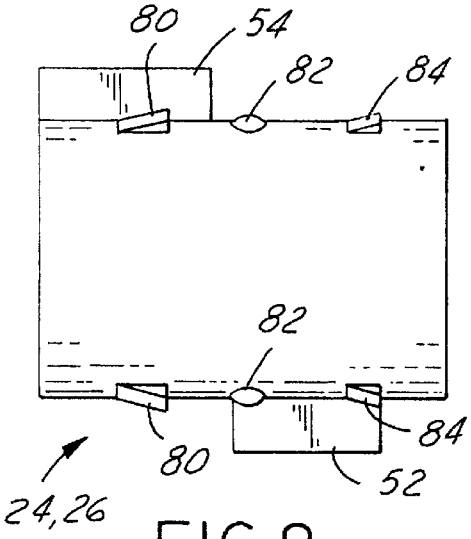
FIG. 8 is a side view of the first or second cap having trailing, mid, and leading projections.
Figure 9:
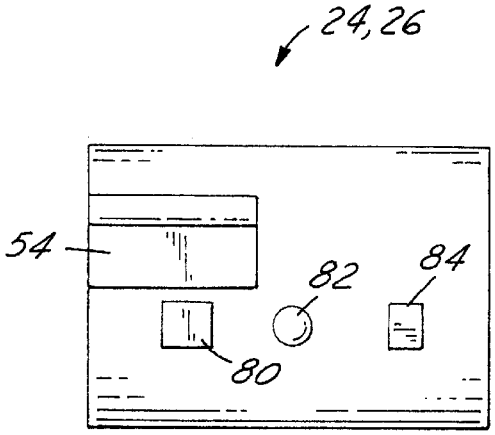
FIG. 9 is a side view of the first or second cap of FIG. 8 rotated ninety degrees.

Referring to FIGS. 8–10, the first and second caps 24, 26 snap fit to the lid 70 of the housing 58 when assembled in the provisional mounted position. The inner edge 78 of lid 70 snaps between a plurality of spaced circumferentially and aligned axially trailing projections 80 and a plurality of spaced circumferentially and aligned axially mid projections 82. The trailing projections 80 engage beneath the lid 70 and are wedge shaped sloping radially inward in a trailing direction toward the carburetor body 22. The mid projections 82 are semi-spherical and frictionally engage the lid 70 from above.

After final flow adjustments are made (typically when assembled on an operating engine and by the engine manufacturer), and the caps of the assembly 20 are moved axially to a final user position, the serrated head 34 is engaged fully within the leading bore 48 and a plurality of leading projections 84 of the first and second caps 24, 26 snap fit beneath the lid 70. The leading projections 84 are spaced circumferentially and aligned axially on the peripheral face 56. When the heads 34 are fully inserted into the leading bore 48 of the first and second caps 24, 26, the leading projections 84 resiliently snap past the inner edge of the lid 70, thereby providing the manufacture a positive indication that the caps 24, 26 are fully engaged. The leading projections 84 also assure that the caps 24, 26 do not vibrate loose and fall out of the housing 58 once fully engaged.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

I claim:

1. A cap assembly for limiting adjustment of fuel flow in a carburetor comprising:

a cylindrical first cap having a first peripheral face, a first tab and a second tab, the first and second tabs each project radially outward from the peripheral face, the first tab being axially and circumferentially offset from the second tab;

a low speed valve having a rotatable shank and a head, the head projecting from the carburetor, the first cap engaged telescopically to the head;

a cylindrical second cap disposed parallel to the first cap, the second cap having a peripheral face, the first tab of the first cap being in contact with the peripheral face of the second cap when the low speed valve is in a maximum fuel amount position, the second tab of the first cap being in contact with the peripheral face of the second cap when the low speed valve is in a minimum fuel amount position;

a housing having a continuous wall extending from the carburetor and encircling the valve and the first and second caps; and a lid carried by the housing, disposed over the first and second caps and having an inner edge defining an opening having a profile matching the cross-sectional profile of the first and second caps so that each of the caps can be inserted through the opening into the housing; and the caps and the lid are configured and dimensioned so that when the caps are fully received in the housing, the tabs are axially inboard of the lid and will pass under the lid when the low speed valve is rotated to adjust fuel flow.

2. The cap assembly according to claim 1 wherein the first cap is identical to the second cap, the first cap being aligned axially radially with the second cap.

3. The cap assembly according to claim 2 wherein the second cap is mounted to the carburetor at 180 degrees out of phase with the rotational mounting of the first cap.

4. The cap assembly according to claim 1 further comprising a high speed valve having a rotatable shank and a head, the shank of the low speed valve disposed parallel to the shank of the high speed valve, the low speed valve rotating uni-directionally to the high speed valve, the second cap engaged telescopically to the head of the high speed valve, a second tab ofthe second cap in contact with the peripheral face ofthe first cap when the high speed valve is in a maximum fuel amount position, a first tab of the second cap in contact with the peripheral face of the first cap when the high speed valve is in a minimum fuel amount position.

5. The cap assembly according to claim 3 further comprising a high speed valve having a rotatable shank and a head, the shank of the low speed valve disposed parallel to the shank of the high speed valve, the low speed valve rotating counter-directionally to the high speed valve, the second cap engaged telescopically to the head of the high speed valve, the first tab of the second cap in contact with the peripheral face of the first cap when the high speed valve is in a maximum fuel amount position, the second tab of the second cap in contact with the peripheral face of the first cap when the high speed valve is in a minimum fuel amount position.

6. The cap assembly according to claim 4 wherein the heads of the low and high speed valves each have a leading surface having a diametric recess t ransverse to the shank longitude.

7. The cap assembly according to claim 6 wherein the heads of the low and high speed valves each have an outer radial surface having serrations extended axially, the first and second caps each having a leading bore extended axially, the bore defined by a leading inner radial surface, the leading inner radial surface having serrations extended axially for engaging the serrations of the respective heads.

8. The cap assembly according to claim 7 wherein the first and second caps each have a trailing bore, a tool through hole, and a diametric slot, the leading bore disposed communicatively and concentrically between the trailing bore and the tool through hole, the trailing bore extended radially outward further than the leading bore, the diametric slot aligned axially to and extended transversely across the tool through hole, the tool through hole communicating with the leading bore.

9. The cap assembly according to claim 8 wherein the wall of the housing has a secured end, a free end, and an inner surface, the secured end attached to the carburetor, the wall extended between the secured and free ends, and a cavity defined by the inner surface of the wall.

10. The cap assembly according to claim 9 wherein the inner surface of the wall defines a recess disposed at the free end, and wherein the lid has a peripheral edge engaged to the inner side within the recess, the lid disposed over the first and second caps.

11. The cap assembly according to claim 10 wherein the opening profile matches the cross sectional profile of the first and second caps when in a provisional mount position, the opening disposed directly over the first and second caps.

12. The cap assembly according to claim 11 wherein the provisional mount position is configured with the first tab of the first cap in contact with the peripheral face of the second cap, the second tab of the second cap in contact with the peripheral face of the first cap, and the heads of the low and high speed valves are disposed rotationally within the trailing bores of the respective first and second caps.

13. A cap assembly for limiting adjustment of fuel flow in a carburetor comprising:

a cylindrical first cap having a first peripheral face, a first tab and a second tab, the first and second tabs each project radially outward from the peripheral face, the first tab being axially and circumferentially offset from the second tab;

a low speed valve having a rotatable shank and a head, the head projecting from the carburetor, the first cap engaged telescopically to the head;

a cylindrical second cap disposed parallel to the first cap, the second cap having a peripheral face, the first tab ofthe first cap being in contact with the peripheral face of the second cap when the low speed valve is in a maximum fuel amount position, the second tab of the first cap being in contact with the peripheral face of the second cap when the low speed valve is in a minimum fuel amount position;

a housing having a continuous wall extending from the carburetor and encircling the valve and the first and second caps;

a lid carried by the housing, disposed over the first and second caps and having an inner edge defining an opening having a profile matching the cross-sectional profile of the first and second caps so that each of the caps can be inserted through the opening into the housing, a high speed valve having a rotatable shank and a head, the shank of the low speed valve disposed parallel to the shank of the high speed valve, the low speed valve rotating uni-directionally to the high speed valve, the second cap engaged telescopically to the head of the high speed valve, a second tab of the second cap in contact with the peripheral face of the first cap when the high speed valve is in a maximum fuel amount position, a first tab of the second cap in contact with the peripheral face of the first cap when the high speed valve is in a minimum fuel amount position; and the first and second caps each have a leading bore, a trailing bore concentric with and radially outward of the leading bore, a plurality of trailing projections and a plurality of mid projections, the plurality of trailing projections being aligned axially and wedge shaped, the trailing projections sloping radially inward in the axial trailing direction, the plurality of mid projections being aligned axially and semi-spherical, the inner edge of the lid snap fitted between the trailing projections and the mid projections of the first and second caps thereby receiving and retaining the heads of the low and high speed valves within the trailing bores of the first and second caps with the low and high speed valves being free to rotate relative to the respective first and second caps.

14. The cap assembly according to claim 13 wherein the first and second caps each have a plurality of wedge shaped leading projections aligned axially and sloping radially inward in the axial trailing direction, the leading projections of the caps being snap fitted beneath the inner edge of the lid when the leading bores are engaged to the peripheral sides of the low and high speed valve heads.

15. The cap assembly according to claim 14 wherein the peripheral edge of the lid has outward extending fingers attached to the free end of the wall by an adhesive disposed between the free end and the fingers.

16. The cap assembly according to claim 15 wherein the first and second caps are each unitary and molded of a synthetic resin material.

* * * * *

UNITED STATES PATENT AND TRADEMARK OFFICE

CERTIFICATE OF CORRECTION

PATENT NO. : 6,467,757 B1
DATED : October 22, 2002
INVENTOR(S) : Yoshiaki Douyama It is certified that error appears in the above-identified patent and that said Letters Patent is hereby corrected as shown below:

Column 6,
Line 47, delete “ofthe” and insert -- of the --.
Line 66, delete “t ransverse” and insert -- transverse --.

Signed and Sealed this

Sixteenth Day of September, 2003

JAMES E. ROGAN
*Director of the United States Patent and Trademark Office*